US005634859A

United States Patent [19]

Nesbitt

[11] Patent Number: 5,634,859

[45] Date of Patent: Jun. 3, 1997

[54] GRIP WITH INCREASED SOFT FEEL AND TACKINESS WITH DECREASED TORQUE

[75] Inventor: R. Dennis Nesbitt, Westfield, Mass.

[73] Assignee: Lisco, Inc., Tampa, Fla.

[21] Appl. No.: 527,278

[22] Filed: Sep. 12, 1995

[51] Int. Cl.[6] ..... A63B 49/08

[52] U.S. Cl. ..... 473/301; 473/300; 473/302; 473/303

[58] Field of Search ..... 273/735, 81 R, 273/81.2, 81 D

[56] References Cited

U.S. PATENT DOCUMENTS

| | | | |
|---|---|---|---|
| 631,648 | 8/1899 | Lockwood | 273/81 R |
| 2,115,119 | 4/1938 | Park | 273/81 R |
| 4,261,567 | 4/1981 | Uffindell | 273/81 |
| 4,338,270 | 7/1982 | Uffindell | 264/64.4 |
| 4,639,029 | 1/1987 | Kolonia | 294/57 |
| 4,819,939 | 4/1989 | Koboyashi | 273/81 R |
| 4,919,420 | 4/1990 | Sato | 273/81 B |
| 4,941,232 | 7/1990 | Decker et al. | 16/111 R |
| 4,953,861 | 9/1990 | Nakanishi | 273/73 J |
| 4,964,192 | 10/1990 | Marui | 16/111 R |
| 4,974,846 | 12/1990 | Fenton | 273/81 B |
| 4,984,793 | 1/1991 | Chen | 273/75 |
| 4,989,870 | 2/1991 | Janes | 273/73 J |
| 5,042,804 | 8/1991 | Uke et al. | 273/75 |
| 5,088,734 | 2/1992 | Glava | 273/73 J |
| 5,261,665 | 11/1993 | Downey | 273/81 B |
| 5,322,290 | 6/1994 | Minami | 273/81 B |

FOREIGN PATENT DOCUMENTS

| | | | |
|---|---|---|---|
| 2251801 | 7/1992 | United Kingdom | 273/81 R |
| 2277275 | 10/1994 | United Kingdom | 273/81 R |

OTHER PUBLICATIONS

The Hardest Part Is Letting Go Percise (No Date Shown).

*Primary Examiner*—Aaron J. Lewis
*Assistant Examiner*—Charles W. Anderson

[57] ABSTRACT

A grip comprising an interior surface and an exterior surface. The interior surfaces and exterior surfaces are essentially coaxial. The grip is fabricated of two layers along its length, an inner layer and an outer layer. The inner layer is fabricated of a relatively hard shore A hardness of between about 70 and 90 and the outer layer is fabricated of a relatively soft shore A hardness of between about 30 and 50. The outer layer and inner layer being molded together.

2 Claims, 1 Drawing Sheet

GRIP WITH INCREASED SOFT FEEL AND TACKINESS WITH DECREASED TORQUE

BACKGROUND OF THE INVENTION

1. Field of the Invention

The present invention relates to a grip with increased soft feel and tackiness and with decreased torque and more particularly pertains to golf club grips which are more comfortable through increased softness and tackiness and more efficient through decreased torque.

2. Description of the Prior Art

The use of grips for golf clubs and other sporting implements of various designs and configurations is known in the prior art. More specifically, grips for golf clubs and other sporting implements of various designs and configurations heretofore devised and utilized for the purpose of rendering such grips more comfortable and more functional are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,261,567 to Uffindell discloses a hand grip for a hand-held implement, e.g., a golf club, that consists of a rigid cap and a one-piece flexible foam tubular sleeve. The cap is structured to cooperate with the implement's handle shaft for locating and retaining the grip on that shaft, and for protecting the end of the shaft and the outer end of the foam sleeve. The one-piece flexible foam sleeve, preferably with an outer skin thereon to resist abrasion, provides a cushioned grip to the user. A method is also provided by which the rigid cap and foam sleeve grip are fabricated.

U.S. Pat. No. 4,338,270 to Uffindell discloses a method of fabricating a composite foam hand held implement grip. A hand grip for a hand-held implement, e.g., a golf club, that consists of a rigid cap and a one-piece flexible foam tubular sleeve. The cap is structured to cooperate with the implement's handle shaft for locating and retaining the grip on that shaft, and for protecting the end of the shaft and the outer end of the foam sleeve. The one-piece flexible foam sleeve, preferably with an outer skin thereon to resist abrasion, provides a cushioned grip to the user. A method is also provided by which the rigid cap and foam sleeve grip are fabricated.

U.S. Pat. No. 4,639,029 to Kolonia discloses a tool handle. A tool handle comprises a composite structure including a core member having a molded plastic outer coating over the core member, the molded plastic composite structure has a socket end, and intermediate section and a butt end. The socket end includes a substantially circular outside diameter for insertion into a socket portion of the tool on which the handle fits. The intermediate section is oval-shaped in cross-section along substantially the entire length thereof and has a transition portion connecting the circular socket end to the oval-shaped intermediate cross-section. The oval-shaped cross-section is effective to facilitate handling of the tool when the socket end is inserted into the socket portion of the tool. Particular features of the invention are directed to various specifically shaped core members, socket ends and butt ends. Other specific features of the invention are directed to the manner in which the tool handle is connected in a socket portion of a tool or with a shank portion of a tool. The tool handle of the invention is particularly useful with hand tools such as shovels, spading forks, pitch forks and the like.

U.S. Pat. No. 4,919,420 to Sato discloses a grip of a golf club and a manufacturing method thereof. A grip of a golf club according to the present invention prevents slipping, when the grip is grasped by a hand opposite to a whip hand, by applying an area having a plurality of projections to the are of the grip corresponding to the respective bases of the middle finger, the ring finger and the little finger of the palm of the hand opposite to said whip hand and to the palm located on the extension of the neighborhood of the base of the little finger of said palm. Also, since there is an area where a plurality of projections or dents are formed being separated independently one by one. Accordingly, when the whole of the element body of the grip is ground from the surface in a uniform depth, the fiber is exposed in the area having a plurality of plane portions and the fiber is not exposed in the area having a plurality of jogs. In this area where the fiber is exposed, a moderate non-slip effect is obtainable and soft grip feeling is presented.

U.S. Pat. No. 4,941,232 to Decker discloses a slip resistant, cushioning cover for handles. A slip-resistant, flexible, cushioning wrap for a handle comprising a laminate suitable for covering the handle. The laminate has a base layer of cushioning, non-absorbent closed-cell foam having an outer layer of washable, grip-enhancing, random and open-cell foam laminated to one side and having a pressure sensitive adhesive applied to the other side. The laminate may be formed as a sheet or a tube. A sheet of laminate may be cut to conform to the contours of the handle and then wrapped about the handle with the edges either overlapping of abutting. A tube of laminate may also be formed to fit the contours of the handle.

U.S. Pat. No. 4,953,861 to Nakanishi discloses a ball hitting sports tool. A ball hitting sports tool has a ball hitting part and a grip part which is integrated with the ball hitting part through a stem and at least one of the ball hitting part, stem and grip part is provided with a buffer part in which a gel material with a penetration value of approximately 50 to 200 is used as a buffer material.

U.S. Pat. No. 4,964,192 to Marui discloses a multiple radius grip. A cushioned grip having a unitary tubular-shaped body portion with an asymmetrical off-center cross-sectional shape. The asymmetrical off-center shape provides increased cushioning on portions thereof while retaining a moderate sized circumference. The asymmetrical cross-sectional shape provides a first portion having a first thickness of cushioning material, a second portion having a second lower thickness of cushioning material and a third portion of further reduced thickness of cushioned material. The third portion of cushioning is provided with a flat surface to provide a positive and solid feel to the fingers while grabbing the grip. The center's curvature defined by the outside of the cross-sectional shape of the grip is displaced from the center of the inside portion which is generally circular and adapted to receive a hard round member such as a bicycle handlebar to be cushioned. The cushioning thickness may vary from a relatively small value at one end of the grip to a maximum in a central region and reducing again to a smaller thickness at the other end to provide a varying circumference for different size hands.

U.S. Pat. No. 4,984,793 to Chen discloses a racket handle cap of a pliant material in single piece injection molded construction and comprises an opening at one end therefrom elongatedly extending along a grip portion to a flaring section to define an internal cavity, an adhesive tape and a plurality of counter weights. The grip portion has a plurality of oval circulation vents and circular air circulation vents which are respectively formed in rows for eliminating the air therethrough by inserting the handle part of a racket frame thereto. The counter weights respectively conform in shape with the oval circular air circulation vents for defining their optional and removable insertion to the oval and circular air circulation vents, whereby the weight adjustment and distribution of said racket handle cap being achieved.

U.S. Pat. No. 5,042,804 to Uke discloses a hand grip for sporting equipment or tools. A handle grip for fitting on the handle shaft of a sporting implement or tool, for example a racket or bat, comprises an elongate sleeve of elastomeric material having an internal surface for fitting over the handle shaft and an outer, gripping surface for gripping by the user's hand. The grip has indentations on at least one of its inner and outer surfaces which extend over part of the surface area to provide regions of varying softness. The softness is provided by the thinned out or indented regions bending or collapsing under load against the hand.

U.S. Pat. No. 5,088,734 to Glava discloses an attenuating handle for recreational and work implements. A hand-operated implement, which is a shock-producing or vibration-producing implement, having an attenuating handle. The implement has a handle attached to the implement, which handle has a central core, a gripping surface and a gel shock- or vibration-absorbing material positioned adjacent to or recessed in the core and under the gripping surface, wherein the gel shock- or vibration-absorbing material is a gel having a cone penetration between about 100 and 350 (10–1 mm) and an ultimate elongation of at least 100 percent and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interferes with the use of control of the implement, thereby absorbing the shock or vibration produced by the implement without significantly changing the operating control characteristics of the implement. Also disclosed is a method of attenuating shock and vibration in a handle of an implement.

U.S. Pat. No. 5,261,665 to Downey discloses a golf club grip formed of a plurality of materials and method of manufacture thereof. The golf club grip is formed of a hollow, inner socket and an outer jacket produced from different charges of thermoplastic rubber. The socket and jacket differ in stiffness characteristics, colors, or both stiffness and color. The outer jacket is molded onto the socket and bonded thereto throughout the surface of contact therebetween. The torsional stress on the jacket is transmitted to and resisted by the inner socket through the bonding that occurs throughout the interface between the jacket and the socket. Preferably, the socket has an inner socket core portion with a plurality of radially projecting protrusions. The structure of the jacket laterally surrounds the protrusions so that the outermost surfaces of the protrusions are exposed. The golf club grip is produced from a pair of identical mounting cores which are rotated between a pair of molding dies. The sockets are first produced on one mounting core in a first die, and the first mounting core with the socket thereon is cyclically moved into the second die. While the jacket of the golf club grip of the invention is being molded onto the socket just produced in the first die, a new socket is concurrently produced on the second mounting core, which has been moved into the first die.

Lastly, U.S. Pat. No. 5,322,290 to Minami discloses a golf club grip. A golf club grip has a double-layer structure comprising an inner layer and an outer layer aminated on the outer surface of the inner layer. One of the inner and outer layers is made of a first material, while the other layer is made of a second material. The first material has an elasticity which is higher than that of the second material so that the first material is more readily elastically deformable than the second material, while the second material has a viscoelasticity which is higher than that of the first material.

In this respect, the golf club grip with increased soft feel and tackiness and with decreased torque according to the present invention substantially departs from the conventional concepts and designs of the prior art, and in so doing provides an apparatus primarily developed for the purpose of rendering a golf club grip more comfortable through increased softness and tackiness and more efficient through decreased torque.

Therefore, it can be appreciated that there exists a continuing need for new and improved golf club grip with increased soft feel and tackiness and with decreased torque which can be used for rendering a golf club grip more comfortable and more efficient. In this regard, the present invention substantially fulfills this need.

SUMMARY OF THE INVENTION

In view of the foregoing disadvantages inherent in the known types of grips for golf clubs and other sporting implements of various designs and configurations now present in the prior art, the present invention provides an improved golf club grip with increased soft feel and tackiness and with decreased torque. As such, the general purpose of the present invention, which will be described subsequently in greater detail, is to provide a new and improved golf club grip with increased comfort and efficiency which has all the advantages of the prior art and none of the disadvantages.

To attain this, the present invention essentially comprises a golf club grip having an increased soft feel and tackiness with decreased torque comprising, in combination, an interior surface in a generally cylindrical configuration and an exterior surface in a generally frustroconical configuration. The interior surfaces and exterior surfaces have a common axis and extending between an open lower end for positioning and removal of the grip with respect to a cylindrical golf club shaft and a closed end positionable adjacent to the end of the golf club being covered. The axis is about 10½ inches in length with the exterior surface 1⅛ inches in diameter at its upper end and about ⅝ inches in diameter at its lower end with a thickness of about 9/32 inches at its upper end and about 1/16 inches at its lower end. The grip is fabricated of two layers along its length, an inner layer and an outer layer. The inner layer is fabricated of a relatively hard shore A hardness of between about 70 and 90 and the outer layer being fabricated of a relatively soft shore A hardness of between about 30 and 50. The outer layer and inner layer are molded together with the outer layer constituting between about 50 and 25 percent of the thickness of the grip along its entire length. The inner layer includes a 100 parts Natsyn, 60 parts 550 Black, 15 parts zinc oxide, 1 part Naugagard, 2 parts stearic acid, 2 parts Vanfre, 10 parts HiSil 233, 1 part Durax, 0.2 parts Unads, and 2 parts sulfur. The outer layer is fabricated of 98 parts SMR 60 CV, 4 parts Black Masterbatch Color, 5 parts zinc oxide, 2 parts stearic acid, 2.75 parts sulfur, 1 part Captax and 0.1 part Methyl Tuads.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf club grip with increased soft feel and tackiness and with decreased torque which has all the advantages of the prior art grips and none of the disadvantages.

It is another object of the present invention to provide a new and improved golf club grip with increased soft feel and tackiness and with decreased torque which may be easily and efficiently manufactured, marketed and utilized.

It is a further object of the present invention to provide a new and improved golf club grip with increased soft feel and tackiness and with decreased torque which is of a durable and reliable construction.

An even further object of the present invention is to provide a new and improved golf club grip with increased soft feel and tackiness and with decreased torque which is susceptible of a low cost of manufacture with regard to both materials and labor, and which accordingly is then susceptible of low prices of sale to the consuming public, thereby making such grips for golf clubs economically available to the buying public.

Still another object of the present invention is to render a golf club grip more comfortable through increased softness and tackiness and more efficient through decreased torque.

Lastly, it is an object of the present invention to provide a new and improved grip comprising an interior surface and an exterior surface. The interior surfaces and exterior surfaces are essentially coaxial. The grip is fabricated of two layers along its length, an inner layer and an outer layer. The inner layer is fabricated of a relatively hard shore A hardness of between about 70 and 90 and the outer layer is fabricated of a relatively soft shore A hardness of between about 30 and 50. The outer layer and inner layer being molded together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
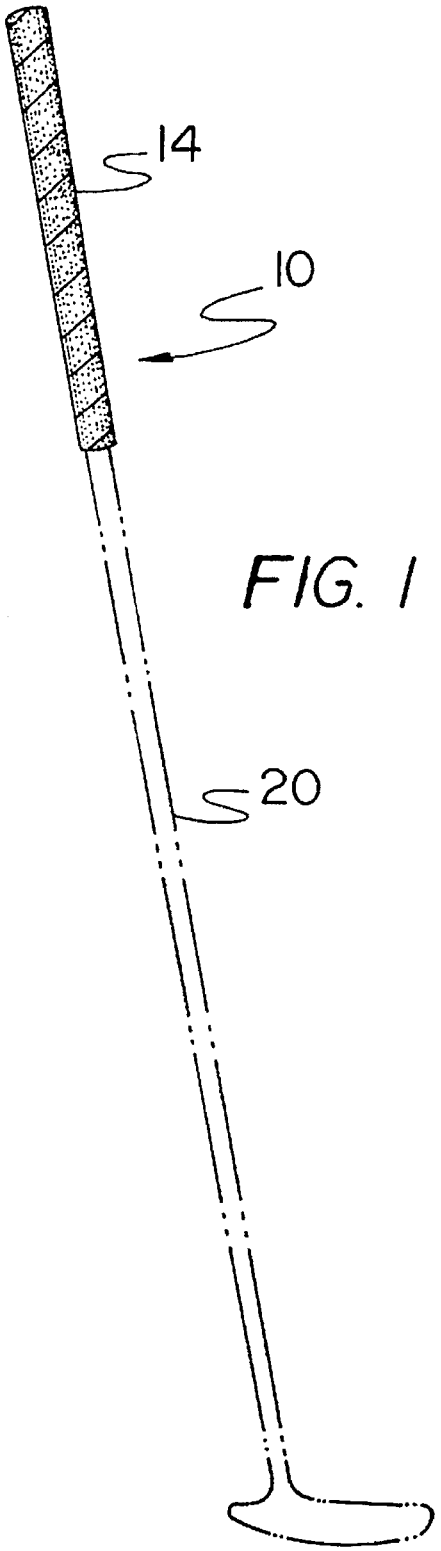
FIG. 1 is a perspective illustration of the preferred embodiment of the golf club grip with increased soft feel and tackiness with decreased torque constructed in accordance with the principles of the present invention.
Figure 2:
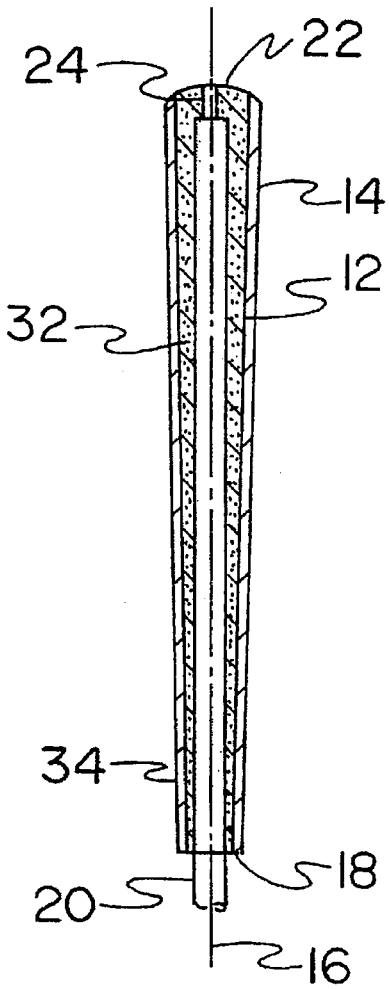
FIG. 2 is a cross-sectional view of the grip shown in FIG. 1.
Figure 3:
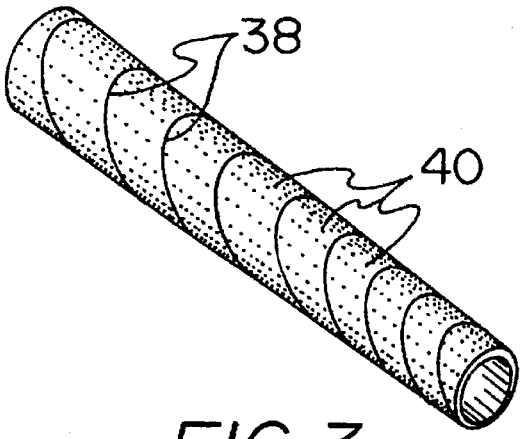
FIG. 3 is an enlarged perspective view of the grip of FIGS. 1 and 2.

With reference now to the drawings, and in particular to FIG. 1 thereof, a new and improved golf club grip with increased soft feel and tackiness with decreased torque embodying the principles and concepts of the present invention and generally designated by the reference numeral 10 will be described.

The present invention is in a golf club grip 10. The grip is designed so as to provide for an increased soft feel during play. It is also designed for increased tackiness during play. In addition to comfort, the grip is designed for improved function by decreased torque during a golf swing. It should be understood that the golf grip as disclosed herein is the primary embodiment. The present invention is also adapted for use on other implements including ski poles and rackets for tennis, racquetball, paddle ball and like sports as well as on other devices including tools such as screwdrivers, hammers, pliers and the like.

The general overall configuration of the grip is generally conventional. It includes an interior surface 12. The interior surface is formed in a generally cylindrical configuration. It also has an exterior surface 14. Such exterior surface is in a generally frustroconical configuration. The interior surface and exterior surface have a common axis 16.

The grip extends between an open lower end 18. The lower open end is for positioning the grip with respect to the upper end of a cylindrical golf club shaft 20 and for the removal thereof. In addition, the grip has an upper closed end 22. Such upper closed end is positionable adjacent to the upper end of a golf club being covered. The closed end has an air hole 24 therethrough.

The axis of the grip is about 10½ inches in length with the exterior surface being about 1⅛ inches in diameter at its upper closed end. The grip also has its exterior surface with a diameter of about ⅝ inches at its lower open end. The thickness of the grip is therefor about 9/32 inches at its upper closed end and about 1/16 inches at its lower open end.

The playing characteristics of the grip described above are achieved through the materials of which is it fabricated. Fabrication is done by forming the grip in two layers along its length, an inner layer 32 and an outer layer 34. The inner layer is fabricated of a relatively hard Shore A hardness of between about 70 and 90. The outer layer is fabricated of a relatively soft Shore A hardness of between about 30 and 50. The inner layer is of a thickness between 75 and 50 percent of the thickness of the grip between its thicker upper end and thinner lower end. The outer layer is a thinner layer of about 1/16 inches throughout its entire extent.

The inner and outer layers are molded together during their fabrication process. In view of the dimensions, the outer layer constitutes between about 50 and 25 percent of the thickness of the grip varying continuously along its length.

The inner layer is an elastomer fabricated of about 100 parts Natsyn, this is about 51.76 percent by weight of the entire inner layer. Natsyn is a trademark of the Goodyear Corporation. The function of the Natsyn is to provide a rubber base. Also included as a major component of the inner layer are 60 parts of 550 Black, 31.06 percent by weight of the inner layer. Black is a trademark of the Cabot Corporation. The function of the Black is to provide harness and tear strength. The third major component is 15 parts zinc oxide which constitutes about 7.76 percent by weight of the inner layer. The function of the zinc oxide is to activate vulcanization.

The minor components of the inner layer include 1 parts Naugagard, 0.52 percent by weight of the inner layer. The function of the Naugagard is to provide antioxidant protection of the rubber compound.

The next minor component of the inner layer is 2 parts stearic acid, 1.04 percent by weight of the inner layer. The function of stearic acid is to activate and improve processing.

The next minor component of the inner layer is 2 parts Vanfre, 1.04 percent by weight of the inner layer. Vanfre is a trademark of the Vanderbilt Corporation. The function of the Vanfre is to improve processing.

The next minor component of the inner layer is 10 parts HiSil 233, 5.18 percent by weight of the inner layer. HiSil 233 is a trademark of the PPG Corporation. The function of the HiSil 233 is to provide hardness and reinforcement.

The next minor component of the inner layer is 1 parts of Durax, 0.52 percent by weight of the inner layer. Durax is a trademark of the Vanderbilt Corporation. The function of the Durax is to accelerate vulcanization.

The next minor component of the inner layer is 0.2 parts of Unads, 0.10 percent by weight of the inner layer. Unads is a trademark of the Vanderbilt Corporation. The function of the Unads is to also accelerate vulcanization.

The final minor component of the inner layer is 2 parts of sulfur, 1.04 percent by weight of the inner layer. Sulfur is a chemical of the Stauffer Chemical Corporation. The function of the sulfur is to provide vulcanization.

The outer layer according to the preferred embodiment is fabricated of 98 parts SMR 60 CV, about 86.84 percent. SMR 60 CV is a natural rubber from Malaysia. The function of the SMR 60 CV is to provide a soft rubber base.

Other minor components of the outer layer include 4 parts Black Masterbatch Color, about 3.54 percent. Black Masterbatch is a product of the Colonial Rubber Works Corporation. Its function is to add black color.

The next minor component of the outer layer is 2.75 parts sulfur, about 2.44 percent. Sulfur is a chemical of the Stauffer Chemical Corporation. Its function is to provide vulcanization.

Another minor component of the outer layer is 1 part Captax. Captax is a trademark of the Vanderbilt Corporation. Its function is to accelerate vulcanization.

Another minor component of the outer layer is 0.1 part of methyl tuads, about 0.89 percent. Its function is to accelerate vulcanization.

The final components are 5 parts zinc oxide, about 4.43 percent and 2 parts stearic acid, about 1.78 percent.

In an alternate embodiment, the outer layer is fabricated according to an alternate formulation. Such alternate formulation includes 100 parts, 71.17 percent by weight, Bromo Butyl 2253. Bromo Butyl 2253 is a trademark of the Exxon Corporation. It is a soft rubber base which functions to increase softness, increased dampening and provide a higher co-efficiency of friction.

Other components included in the alternate embodiment are Color Masterbatch which is a trademark of the Disco Corporation and which is in 2 parts, 1.4 percent by weight, while its function is to provide color; zinc oxide which is from the Zinc Corporation of America and which is in 5 parts, 3.56 percent by weight; stearic acid which is in 2 parts, 1.42 percent by weight, while its function is to activate; Sunthana 415 which is a trademark of the Sunoco Corporation and which is in 5 parts, 3.56 percent by weight, while its function is to soften and plasticize; HiSil 233 which is a trademark of the PPG Industries Corporation and which is in 25 parts, 17.79 percent by weight, while its function is to provide tear strength; sulfur which is a chemical of the Stauffer Chemical Corporation and which is in 0.5 parts, 0.36 percent by weight, while its function is to vulcanize; and Captax Bromo which is a trademark of the Vanderbilt Corporation and which is in 1 part, 0.71 percent by weight, while its function is to accelerate vulcanization.

The present invention adds several improvements over the prior art. The particular configuration of materials provides for increased soft feel during play for greater comfort and less abrasion to the hands of a user. In addition, the grip will provide for increased tackiness during play but, particularly when a golfer is sweating. This will keep a proper contact between the hands of a user and the exterior surface of the grip whether or not the golfer is utilizing a golf glove. Further, there is less chance of improper rotation of the grip and club during a swing regardless of whether it is raining or not, whether or not the golfer is sweating or not. Lastly, the materials utilized will also function by decreasing the torque of the golf club during a swing. By torque it is meant the improper rotation of the golf club and its head with respect to the exterior surface of the grip and the golfers hands. As a result, greater control over the club head and golf swing is attained during play with any golf club provided with the grip of the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf club grip having an increased soft feel and tackiness with decreased torque comprising, in combination:

an interior surface in a generally cylindrical configuration and an exterior surface in a generally frustroconical configuration, the interior surfaces and exterior surfaces having a common axis and extending between an open lower end for positioning and removal of the grip with respect to a cylindrical golf club shaft and a closed end positionable adjacent to the end of the golf club being covered, the axis being about 10½ inches in length with the exterior surface being about 1⅛ inches in diameter at its upper end and about ⅝ inches in diameter at its lower end with a thickness of about 9/32 inches at its upper end and about 1/16 inches at its lower end;

the grip being fabricated of two layers along its length, an inner layer and an outer layer, the inner layer being fabricated of a relatively hard shore A hardness of between about 70 and 90 and the outer layer being fabricated of a relatively soft shore A hardness of between about 30 and 50, the outer layer and inner layer being molded together with the outer layer constituting between about 50 and 25 percent of the thickness of the grip along its entire length;

the inner layer including a hundred parts Natsyn, 60 parts 550 Black, 15 parts zinc oxide, 1 part Naugagard, 2 parts stearic acid, 2 parts Vanfre, 10 parts HiSil 233, 1 part Durax, 0.2 parts Unads, and 2 parts sulfur;

the outer layer being fabricated of 98 parts SMR 60 CV, 4 parts Black Masterbatch, 5 parts zinc oxide, 2 parts stearic acid, 2.75 parts sulfur, 1 part Captax and 0.1 part Methyl Tuads.

2. A golf club grip comprising, in combination:

an interior surface in a generally cylindrical configuration and an exterior surface in a generally frustroconical configuration, the interior surfaces and exterior surfaces having a common axis and extending between an open lower end for positioning and removal of the grip with respect to a cylindrical golf club shaft and a closed end positionable adjacent to the end of the golf club being covered, the axis being about 10½ inches in length with the exterior surface being about 1⅛ inches in diameter at its upper end and about ⅝ inches in diameter at its lower end with a thickness of about 9/32 inches at its upper end and about 1/16 inches at its lower end;

the grip being fabricated of two layers along its length, an inner layer and an outer layer, the inner layer being fabricated of a relatively hard shore A hardness of between about 70 and 90 and the outer layer being fabricated of a relatively soft shore A hardness of between about 30 and 50, the outer layer and inner layer being molded together with the outer layer constituting between about 50 and 25 percent of the thickness of the grip along its entire length, the inner layer including about 100 parts Natsyn and about 60 parts 550 Black;

the outer layer being fabricated of about 100 parts Bromo Butyl 2253 and about 25 parts HiSil 233.

* * * * *